US005701856A

United States Patent [19]

Nagano et al.

[11] Patent Number: 5,701,856

[45] Date of Patent: Dec. 30, 1997

[54] SEPARATE OILING TYPE TWO CYCLE ENGINE

[75] Inventors: Toshihiro Nagano, Omiya; Yoshiaki Sato, Uetake; Jun Nishimori, Miyahara; Fusao Tachibana, Shiraoka, all of Japan

[73] Assignee: Fuji Jukogyo Kabushiki Kaisha, Tokyo, Japan

[21] Appl. No.: 755,898

[22] Filed: Dec. 2, 1996

[30] Foreign Application Priority Data

Dec. 28, 1995 [JP] Japan ..... 7-342781

[51] Int. Cl.[6] ..... F01M 33/00

[52] U.S. Cl. ..... 123/73 AD

[58] Field of Search ..... 123/73 AD; 261/23.2, 261/24, 36.2

[56] References Cited

U.S. PATENT DOCUMENTS

| | | | |
|---|---|---|---|
| Re. 32,577 | 1/1988 | Dubois | 123/73 AD |
| 4,743,171 | 5/1988 | Mahoney | 123/73 AD |
| 4,928,390 | 5/1990 | Gassen et al. | 123/73 AD |
| 5,024,190 | 6/1991 | Kameyama | 123/73 AD |
| 5,036,822 | 8/1991 | Kojima | 123/73 AD |
| 5,555,858 | 9/1996 | Katoh | 123/73 AD |

FOREIGN PATENT DOCUMENTS

| | | |
|---|---|---|
| 4191409 | 7/1992 | Japan . |
| 7119553 | 5/1995 | Japan . |

*Primary Examiner*—Marguerite McMahon
*Attorney, Agent, or Firm*—Martin A. Farber

[57] ABSTRACT

A separate oiling type two cycle engine having a diaphragm type float-less carburetor including a metering chamber and a needle valve comprises a fuel reservoir for reserving fuel, a fuel supply port provided at the fuel reservoir for supplying fuel into the fuel reservoir, a fuel passage for connecting the fuel reservoir with the needle valve, a venturi provided immediately upstream of the needle valve, an oil discharge port provided adjacent to the inlet of the venturi for discharging lubricating oil therethrough so as to mix lubricating oil with fuel, and a fuel return port provided at the higher position than the fuel supply port for returning fuel to a fuel tank. Since lubricating oil is supplied to almost all major components of the carburetor, carburetor components such as a choke valve, a throttle valve, fuel passages, jets, metering needles, nozzles and the like can be prevented from being corroded, rusted or clogged by salt water contained in fuel.

2 Claims, 4 Drawing Sheets

SEPARATE OILING TYPE TWO CYCLE ENGINE

BACKGROUND OF THE INVENTION

1. Field of the Invention

The present invention relates to a separate oiling type two cycle engine and more particularly to a separate oiling apparatus for a two cycle engine having a float-less type carburetor.

2. Prior Art

Generally, separate oiling type two cycle engines for marine use or those engines used in coast areas need countermeasures to prevent salt damage. For example, Japanese Unexamined Patent Application laid open No. Toku-Kai-Hei 4-191409 discloses a technology to prevent carburetor components such as a throttle valve or a choke valve from being stained, rusted or corroded by salt contained in the intake air.

According to the technology disclosed in the prior art, an oil supply hole is provided on the upstream side of the bearing section of the choke valve to prevent the valve rotating shaft of butterfly valves from being stuck due to salt damage.

However, a defect of this technology is an insufficient supply of oil to inner components of the carburetor, such as a needle valve, metering needles, metering jets, a metering chamber, and miscellaneous fuel passages, leading to salt damages on these components, Especially, in case where salt water is contained in fuel, it comes into the carburetor together with fuel and may cause corrosion or rust in fuel passages, metering jets. Another defect is oil stuck to the inner wall of the intake manifold due to an inadequate mixing with fuel.

To solve these problems, Japanese Unexamined Patent Application Laid open No, Toku-Kai-Hei 7-119553 discloses a diaphragm type carburetor in which a lubricating oil supply hole is provided downstream of and adjacent to the check valve for supplying fuel into the metering chamber, whereby lubrication of the metering chamber and mixing of fuel with lubricating oil being improved.

However, the above technique also has a disadvantage that the mixing of fuel with oil in the metering chamber become insufficient particularly when the engine is in a wide open throttle condition or at a high speed condition.

SUMMARY OF THE INVENTION

Accordingly, the present invention is intended to minimize the abovementioned shortcomings of previous arts and it is an object of the present invention to provide a separate oiling type two cycle engine capable of lubricating inner components of a carburetor such as fuel passages, miscellaneous metering jets, needle valves and nozzles as well as a choke valve and a throttle valve in order to prevent these carburetor components from being damaged by salt water contained in fuel. Means to achieve the object comprise:

- a needle valve for regulating the amount of fuel;
- a fuel reservoir for reserving fuel;
- a fuel supply port provided at the fuel reservoir for supplying fuel into the fuel reservoir;
- a fuel passage for connecting the fuel reservoir with the needle valve;
- an oil discharge port provided adjacent to the inlet of said needle valve for discharging lubricating oil therethrough so as to mix lubricating oil with fuel; and
- a fuel return port provided at the higher position than the fuel supply port for returning fuel to a fuel tank.

DETAILED DESCRIPTION OF PREFERRED EMBODIMENTS

Figure 2:
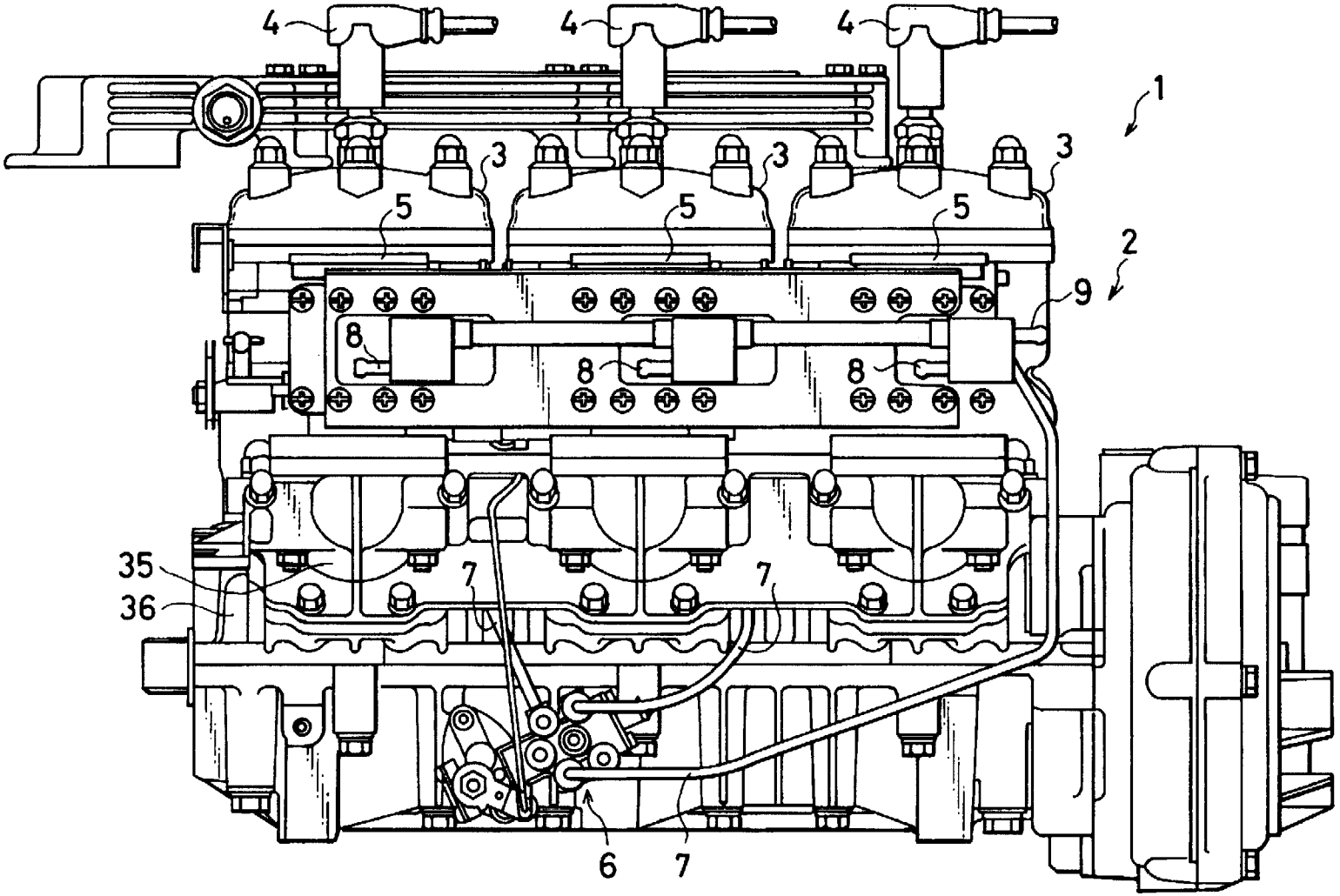
FIG. 2 is a top view of an engine according to the present invention.
Figure 3:
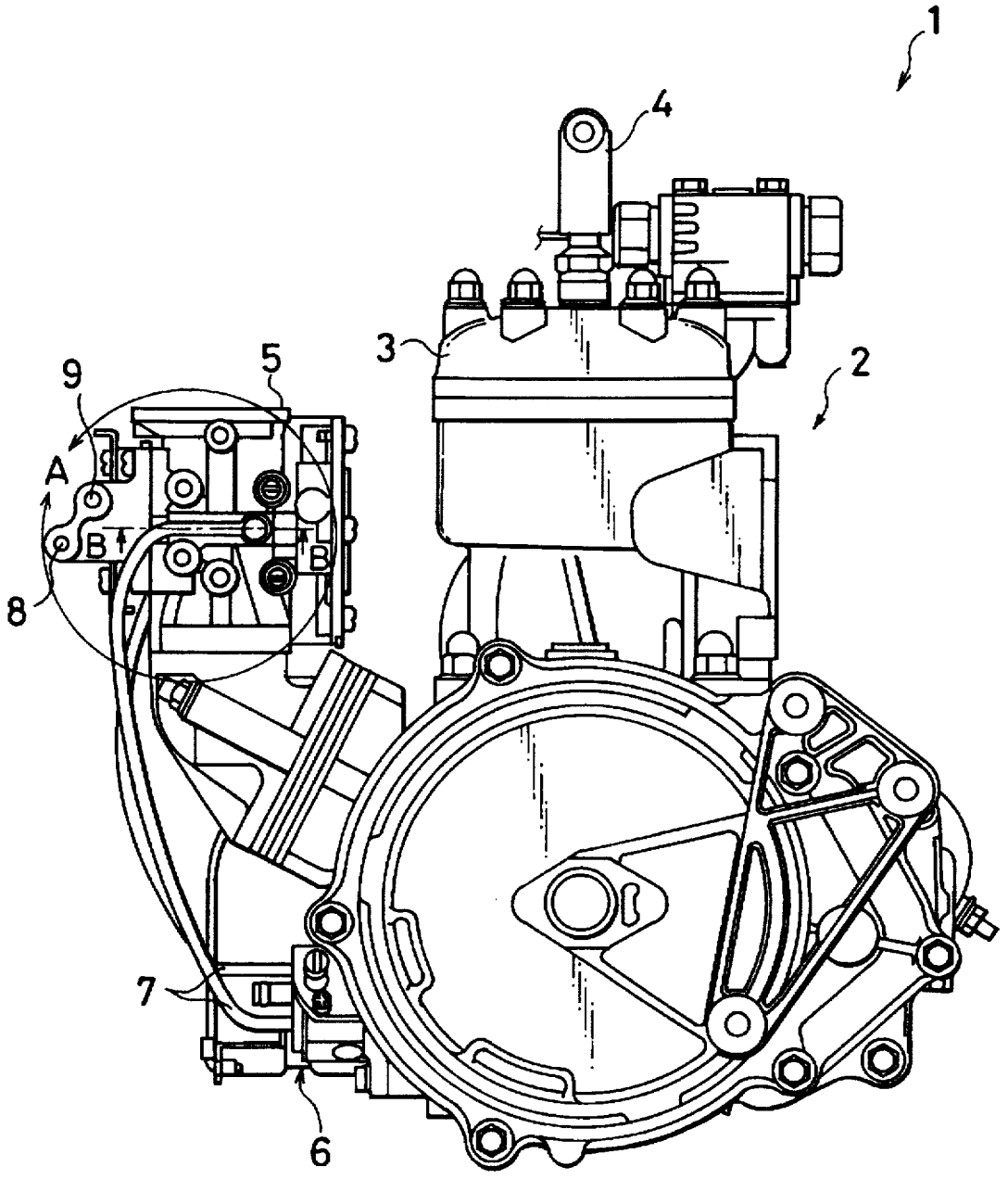
FIG. 3 is a side view of an engine according to the present invention.

Referring now to FIG. 2 and FIG. 3, numeral 1 denotes a separate oiling type two cycle engine and in this embodiment it shows a three-cylinder engine for a personal water craft use. A spark plug 4 is disposed in a cylinder head 3 of a cylinder 2. Further, a carburetor 5 is incorporated on the intake side of each cylinder 3 and an exhaust port (not shown) for each cylinder 3 is formed on the opposite side of the carburetor 5.

Lubricating oil is supplied from an oil pump 6 to each of these carburetors 5 through a pipe 7. Fuel is fed from a fuel tank (not shown) to a fuel supply hole 8 of the carburetor 5 and returned from a fuel return hole 9 to the fuel tank.

Figure 1:
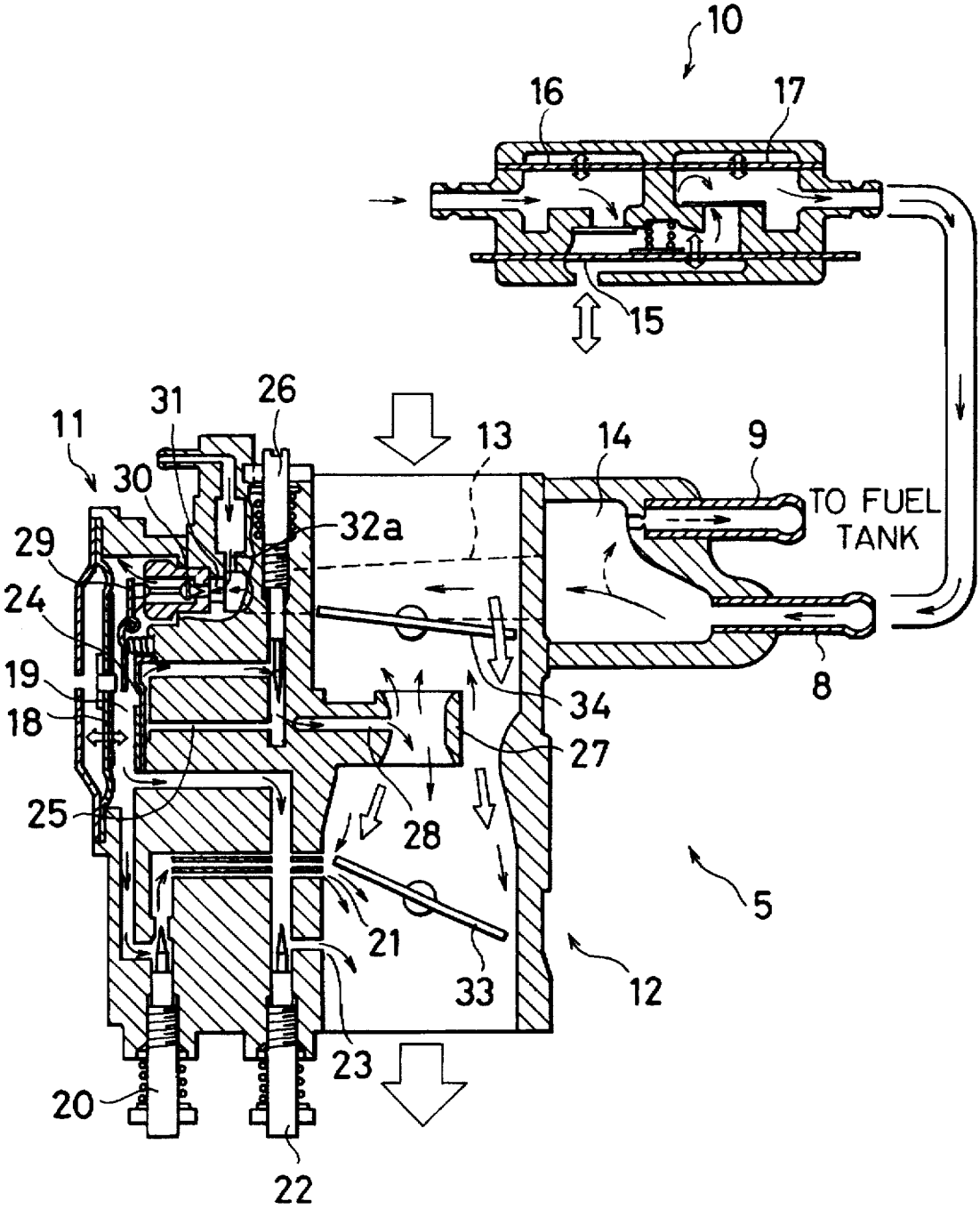
FIG. 1 is a schematic diagram showing a construction and an operation of a carburetor according to an embodiment of the present invention.

Further, as illustrated in FIG. 1, the carburetor 5 is a diaphragm type float-less carburetor which comprises a metering chamber 11 for regulating and reserving fuel supplied from a fuel pump 10, a mixing chamber 12 for forming air-fuel mixture and feeding it to the engine and a fuel reservoir 14 for reserving fuel. The above metering chamber serves as regulating fuel so as to forming a proper air-fuel ratio of mixture gas. Further, there is provided with a fuel passage 13 having a specified length between the metering chamber 11 and the fuel reservoir 14.

The fuel pump 10 feeds fuel from the fuel supply hole 8 to the fuel reservoir 14 by the operation of a spring diaphragm 15, a suction diaphragm 16 and a discharge diaphragm 17 respectively moving up and down according to the changing pressure of the crank case chamber.

Further, in the carburetor 5 there are provided a metering diaphragm 18 operated by the pressure difference between intake negative pressure and atmospheric pressure, a diaphragm chamber 19, a fuel passage connecting the diaphragm chamber 19 with a bypass hole 21 through a slow screw 20, a fuel passage connecting the diaphragm chamber 19 with a pilot outlet 23 through a pilot screw 22 and a fuel passage connecting the diaphragm chamber 19 with a main nozzle 28 of an inner venturi 27 in the mixing chamber 12 through a check valve 24, a main jet 25 and a metering needle 26. The slow screw 20, the pilot screw 22 and the metering needle 26 have been adjusted beforehand respectively so as to obtain a proper amount of fuel.

Further, in the diaphragm chamber 19 of the metering chamber 11, there is provided with a metering arm 29 pushed and operated by the movement of the metering diaphragm 18 so as to open and close a needle valve 30 disposed in the fuel passage 13.

Further, the fuel supply hole 8 is provided in the fuel reservoir 14 so as to supply fuel to the metering chamber 11 through the fuel passage 13 and the needle valve 30 and a fuel return port 9 is provided on the upper side of the fuel supply hole 8 so as to bring back return fuel to the fuel tank therethrough.

Figure 4:
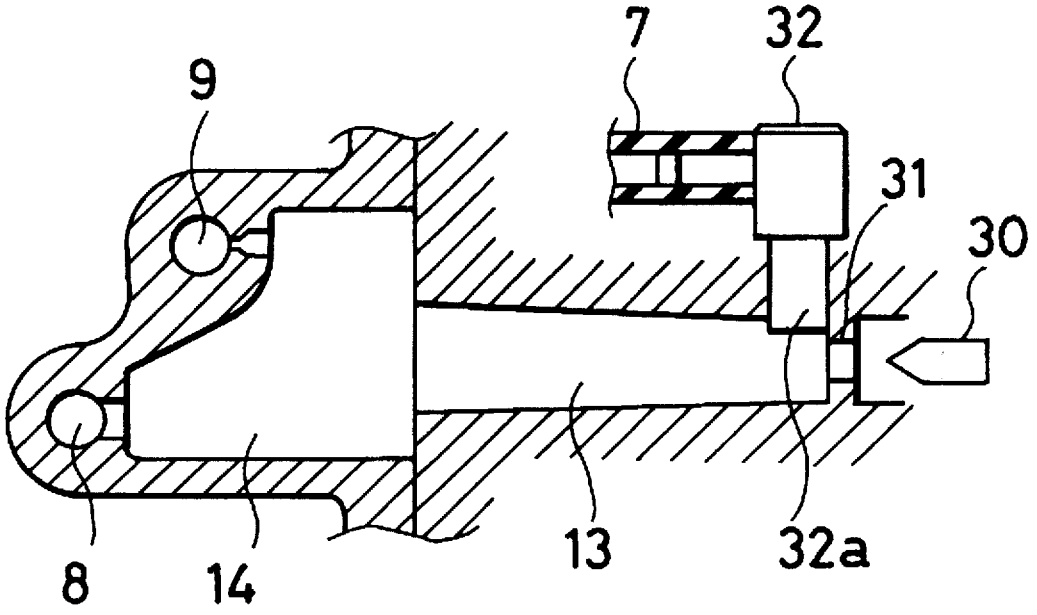
FIG. 4 is an enlarged sectional view of a portion enclosed by a circle A.

Referring to FIG. 4, there is provided with an oil discharge port 32*a* for discharging lubricating oil supplied from the oil pump 6 in the fuel passage 13 immediately adjacent to the entrance of the venturi 31. Further, upstream of the oil discharge port 32a there is provided with a check valve 32 for preventing a reverse flow of oil.

On the other hand, a throttle valve 33 is disposed downstream of the inner venturi 27 of the mixing chamber 12 and a choke valve 34 is disposed upstream thereof. Downstream of the throttle valve 33 an intake pipe 35, a crank case 36 and a cylinder 2 are arranged in this order.

Next, an operation of the carburetor constituted above will be described.

First, when the engine 1 starts cranking, the crank case pressure is changed by the reciprocating motion of the piston and the spring diaphragm 15 of the fuel pump 10 which is connected with the crank case is operated as shown by an arrow mark in FIG. 1. The fuel pump 10 may be used as one for each carburetor or one for all.

The operation of the spring diaphragm 15 induces an operation of the suction diaphragm 16 and the discharge diaphragm 17 and as a result the fuel inside of the fuel pump 10 is sent to the fuel reservoir 14 through the fuel supply hole 8.

On the other hand, the metering diaphragm 18 of the metering chamber 11 is operated by the pressure difference between atmospheric pressure and intake negative pressure to send fuel mixed with lubricating oil to the bypass hole 21 through the slow screw 20, the pilot outlet 23 through the pilot screw 22, and to the main nozzle 28 of the inner venturi 27 through the check valve 24, the main jet 25 and the metering needle 26. Further, the metering diaphragm 18 pushes the metering arm 29 so as to open the needle valve 30.

When the needle valve opens, the fuel in the fuel reservoir 144 flows into the metering chamber 11 through the venturi 31. Then, lubricating oil supplied from the oil pump 6 is discharged from the oil discharge port 32a and mixed with fuel adequately when fuel passes through the venturi 31 and the needle valve 30 with high speed. Further, in the metering chamber 11 the mixing of fuel and oil is enhanced by the vibrating motion of the metering diaphragm 18. When the engine comes into the high speed condition, the vibrating motion of the metering diaphragm 18 becomes small. However, on the other hand, the amount of fuel consumed by the engine increases and the flow speed of fuel becomes so high as to encourage mixing of fuel and oil when they pass through the venturi 31 and the needle valve 30. In this embodiment, the oil discharge port 32a is provided immediately before the venturi 31 but alternatively it may be provided at the other portion adjacent to the inlet of the needle valve 30.

The oil mixed with fuel lubricates the slow screw 20, the pilot screw 22, the check valve 24, the metering needle 26, and miscellaneous fuel passages in the carburetor.

When fuel is ejected from the bypass hole 21, the pilot outlet 23 and the main nozzle 28, it is atomized in the mixing chamber 12 and sucked into the cylinder 2. When fuel is atomized, a part of oil contained in fuel lubricates the choke valve 34 and the throttle valve 33 and the rest of oil is sucked into the cylinder 2 to lubricate the piston. The reason why the choke valve 34 located upstream of the main nozzle 28 is lubricated is that the reverse flow of mixture gas occurs due to the blow-back phenomenon of engine.

The fuel not sent to the metering chamber 11 is returned to the fuel tank through the fuel return port 9 which is located at the high position of the fuel reservoir 14.

Thus, according to the embodiment of the present invention, since lubricating oil is discharged from the oil discharge port which is located immediately before the venturi and is mixed with fuel while fuel and oil pass through the venturi and the needle valve with high speed, and further mixing of fuel and oil is enhanced in the diaphragm chamber by the vibrating operation of the metering diaphragm, miscellaneous fuel passages, metering needles, metering jets and other components in the carburetor can be prevented from being corroded, rusted or clogged by the oil contamination. Further, since the mixing of oil and fuel is conducted more completely as described above, excessive sticking of oil to the inner wall of the intake pipe can be prevented. Further, oil consumption can be regulated properly and smoke emissions particular to two cycle engines can be reduced. Further, since the choke valve and the throttle valve is lubricated enough by lubricating oil, these moving components can be prevented from being stuck due to salt damage.

Further, since the fuel reservoir has an enough volume to reserve fuel and the fuel passage connecting the fuel reservoir with the needle valve has a specified Length so as to restrain the back-flow of lubricating oil, and since lubricating oil has a larger specific gravity than fuel and the fuel return port is located at the high position of the fuel reservoir, fuel mixed with oil can be prevented from being returned to the fuel tank.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A separate oiling type two cycle engine having a diaphragm type float-less carburetor, a fuel tank and a fuel pump, said carburetor including a metering chamber for metering fuel, a needle valve for regulating a fuel flow into said metering chamber and a diaphragm for operating said needle valve, comprising:

a fuel reservoir for reserving a fuel;

a fuel supply port provided at said fuel reservoir for supplying said fuel into said fuel reservoir;

a fuel passage for connecting said fuel reservoir with said needle valve;

an oil discharge port provided adjacent to the inlet of said needle valve for discharging a lubricating oil therethrough so as to mix said lubricating oil with said fuel; and a fuel return port provided at a higher position than said fuel supply port for returning said fuel to said fuel tank.

2. A separate oiling type two cycle engine having a diaphragm type float-less carburetor, a fuel tank and a fuel pump, said carburetor including a metering chamber for metering fuel, a needle valve for regulating a fuel flow into said metering chamber and a diaphragm for operating said needle valve, comprising:

a fuel reservoir for reserving a fuel;

a fuel supply port provided at said fuel reservoir for supplying said fuel into said fuel reservoir;

a fuel passage for connecting said fuel reservoir with said needle valve;

a venturi provided immediately upstream of said needle valve;

an oil discharge port provided adjacent to the inlet of said venturi for discharging a lubricating oil therethrough so as to mix said lubricating oil with said fuel; and a fuel return port provided at the higher position than said fuel supply port for returning said fuel to said fuel tank.

* * * * *